US006382198B1

(12) United States Patent
Smith et al.

(10) Patent No.: US 6,382,198 B1
(45) Date of Patent: May 7, 2002

(54) INDIVIDUAL CYLINDER AIR/FUEL RATIO CONTROL BASED ON A SINGLE EXHAUST GAS SENSOR

(75) Inventors: James Craig Smith, Farmington Hills; Jeff Leon Kainz, Sterling Heights, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/716,816

(22) Filed: Nov. 20, 2000

Related U.S. Application Data

(63) Continuation-in-part of application No. 09/243,939, filed on Feb. 4, 2000, now Pat. No. 6,148,808.

(51) Int. Cl.[7] ..... F02D 41/14
(52) U.S. Cl. ..... 123/673; 123/674
(58) Field of Search ..... 123/673, 674, 123/675, 679; 701/109

(56) References Cited

U.S. PATENT DOCUMENTS 4,483,300 A * 11/1984 Hosaka et al. ..... 123/673
4,934,328 A * 6/1990 Ishii et al. ..... 123/673
5,651,353 A * 7/1997 Allston ..... 123/673
5,657,736 A * 8/1997 Maki et al. ..... 123/673
5,732,689 A * 3/1998 Ohno et al. ..... 123/673
5,794,604 A * 8/1998 Suzuki et al. ..... 123/673
5,947,095 A * 9/1999 Kato ..... 123/673
6,079,205 A * 6/2000 Yasui et al. ..... 123/679
6,148,808 A * 11/2000 Kainz ..... 123/673
2001/0025634 A1 * 10/2001 Poggio et al. ..... 123/673

* cited by examiner

*Primary Examiner*—Willis R. Wolfe
(74) *Attorney, Agent, or Firm*—Vincent A. Cichosz

(57) ABSTRACT

An improved internal combustion engine fuel control wherein a single oxygen sensor responsive to the combined exhaust gas flow of several engine cylinders is used both to control the overall or average air/fuel ratio, and to trim the air/fuel ratio in the individual engine cylinders. The oxygen sensor output is sampled in synchronism with the engine firing events, but at twice (or higher) the frequency, and filtered by an engine speed dependent high-pass filter to form a measure of the air/fuel ratio imbalance with respect to time. The imbalance signal, in turn, is parsed into an array of imbalance values that are associated with individual engine cylinders based on engine operating conditions, and the imbalance values are then used to develop correction factors for the respective engine cylinders that reduce the imbalance while preserving the overall or average air/fuel ratio of the engine.

11 Claims, 3 Drawing Sheets

INDIVIDUAL CYLINDER AIR/FUEL RATIO CONTROL BASED ON A SINGLE EXHAUST GAS SENSOR

RELATED APPLICATIONS

This is a continuation-in-part of U.S. patent application Ser. No. 09/243,939, filed on Feb. 4, 2000, and assigned to the assignee of the present invention now U.S. Pat. No. 6,148,808.

TECHNICAL FIELD

This invention relates to fuel control of a multi-cylinder internal combustion engine, and more particularly a control for carrying out individual cylinder fuel control based on the output signal of a single exhaust gas oxygen sensor.

BACKGROUND OF THE INVENTION

Effective emission control of internal combustion engine exhaust gases with a catalytic converter requires precise control of the air/fuel ratio supplied to the engine cylinders. For this purpose, it is customary to install an oxygen sensor in the engine exhaust pipe, and to use the sensor output as a feedback signal for closed-loop fuel control. Generally, the engine exhaust manifold combines the exhaust gases of several individual cylinders at or near its outlet, and a single oxygen sensor is positioned near the outlet of the exhaust manifold. The controller, in turn, obtains an average reading of the oxygen sensor, and controls the fuel supplied to the engine cylinders to maintain the average air/fuel ratio at a desired value. However, the air/fuel ratio in individual engine cylinders can vary considerably depending on engine hardware design variations and fuel injector performance variations, for example. In other words, certain cylinders tend to run rich, while other cylinders tend to run lean, relative to the desired air/fuel ratio. This imbalance limits the precision of the overall fuel, EGR and spark controls, and therefore limits improvements in both exhaust gas emissions and fuel economy.

In view of the above, it has been proposed to individually control the fuel supplied to each engine cylinder; see, for example, the U.S. Pat. No. 5,651,353 to Allston, issued on Jul. 29, 1997. Some systems of this type utilize multiple oxygen sensors for developing air/fuel ratio feedback signals unique to each cylinder. Some systems utilize a single oxygen sensor, but variations in the transport delay time between a cylinder exhaust port and the oxygen sensor make it difficult to correlate the sensor readings with a given cylinder. In certain instances, transport delay variations are empirically determined for a given engine design, and stored as a fueling calibration. In other instances, mathematical models of the engine and exhaust system are used to compute individual air/fuel ratio feedback signals. The computation approach is often impractical due to through-put limitations, and both approaches suffer inaccuracy due to component variation and degradation over time. Accordingly, what is needed is an individual cylinder fuel control that adaptively balances the air/fuel ratio in the various engine cylinders based on the output signal of a exhaust gas single oxygen sensor without imposing an a severe computational burden on the engine controller.

SUMMARY OF THE INVENTION

The present invention is directed to an improved internal combustion engine fuel control wherein a single oxygen sensor responsive to the combined exhaust gas flow of a bank of engine cylinders is used both to control the overall or average air/fuel ratio, and to trim the air/fuel ratio in the individual engine cylinders. According to the invention, the oxygen sensor output is sampled in synchronism with the engine firing events, but at twice (or higher) the frequency, and filtered by an engine speed dependent high-pass filter to form a measure of the air/fuel ratio imbalance with respect to time. The imbalance signal, in turn, is parsed into an array of imbalance values that are associated with individual engine cylinders based on engine operating conditions, and the imbalance values are then used to develop correction factors for the respective engine cylinders that reduce the imbalance while preserving the overall or average air/fuel ratio of the engine.

DESCRIPTION OF THE PREFERRED EMBODIMENT

Figure 1:
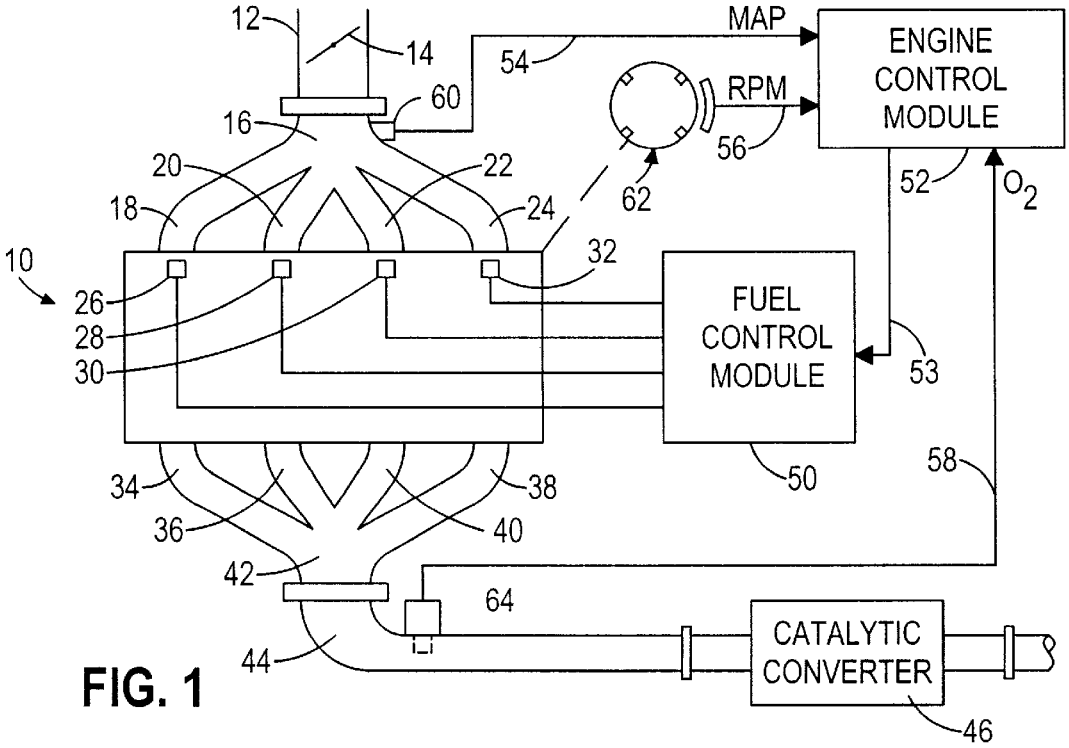
FIG. 1 is a schematic diagram of an internal combustion engine and exhaust system according to this invention, including a single exhaust gas oxygen sensor and a microprocessor-based engine control module.

Referring to the drawings, and particularly to FIG. 1, the reference numeral 10 generally designates an automotive four-cylinder internal combustion engine. Engine 10 receives intake air through an intake passage 12 that is variably restricted by a moveable throttle valve 14. Downstream of throttle valve 14, the intake air enters an intake manifold 16 for distribution to the individual engine cylinders (not shown) via a plurality of intake runners 18–24. The fuel injectors 26–32 are positioned to deliver a predetermined determined quantity of fuel to each intake runner 18–24 for combination with the intake air and admission to respective engine cylinders for combustion therein. The combustion products from each cylinder are exhausted into respective exhaust runners 34–40 of an exhaust manifold 42, and combined in an exhaust pipe 44, which in turn, is coupled to a catalytic converter 46 for emission control purposes.

A fuel control module 50 under the control of a microprocessor-based engine control module (ECM) 52 electrically activates the fuel injectors 26–32. Specifically, ECM 52 develops a fuel command pulse width, or injector on-time, for each of the engine cylinders, and provides the pulse width commands to fuel control module 50 via line 53, and the fuel control module 50 activates the injectors 26–32 accordingly. The fuel pulse widths are determined in response to a number of inputs, including a manifold absolute pressure (MAP) signal on line 54, an engine speed (RPM) signal on line 56, and an oxygen sensor ($O_2$) signal on line 58. The MAP signal is obtained with a conventional pressure sensor 60 responsive the pressure of the intake air in intake manifold 16, the RPM signal may be obtained from a conventional crankshaft or camshaft sensor, generally designated by the reference numeral 62, and the $O_2$ signal may be obtained from a conventional exhaust gas oxygen sensor 64 responsive to the exhaust gasses in exhaust pipe 44. In the illustrated embodiment, the oxygen sensor 64 is of the type having an output that switches or toggles between first and second states corresponding to lean and rich conditions of the sensed exhaust gas, relative to a stoichiometric air/fuel ratio. However, the teachings of this invention also apply to so-called wide-range oxygen sensors which produce an output voltage that varies in amplitude about a DC offset voltage in relation to the deviation of the sensed exhaust gas from the stoichiometric air/fuel ratio.

In general, ECM 52 determines a base fuel amount BASE_FUEL as a function of the RPM and MAP signals, and other inputs such as temperature and barometric pressure. Alternatively, BASE_FUEL may be determined based on a measure of mass air flow in the intake passage 12, using a mass air flow meter upstream of throttle plate 14. The ECM 52 then adjusts BASE_FUEL using previously learned closed-loop corrections, which are typically stored in a electrically-erasable non-volatile look-up table as a function of RPM and MAP. In a global type of fuel control, the adjusted base fuel amount is converted into an injector pulse width and supplied to the fuel control module 50, which activates each of the injectors 26–32 (either sequentially or concurrently) for an on-time corresponding to the supplied injector pulse width, thereby controlling the overall or average air/fuel ratio of the several cylinders to a desired value. In an individual cylinder fuel control according to this invention, however, ECM 52 develops cylinder-specific fuel amounts by determining a correction factor for each cylinder and applying the respective correction factors to the adjusted base fuel amount, and then converts the cylinder-specific fuel amounts into corresponding injector pulse widths. In the case of a four-cylinder engine, for example, ECM 52 supplies four cylinder-specific injector pulse widths to fuel control module 50, which activates the individual fuel injectors 26—32 accordingly.

Figure 2:
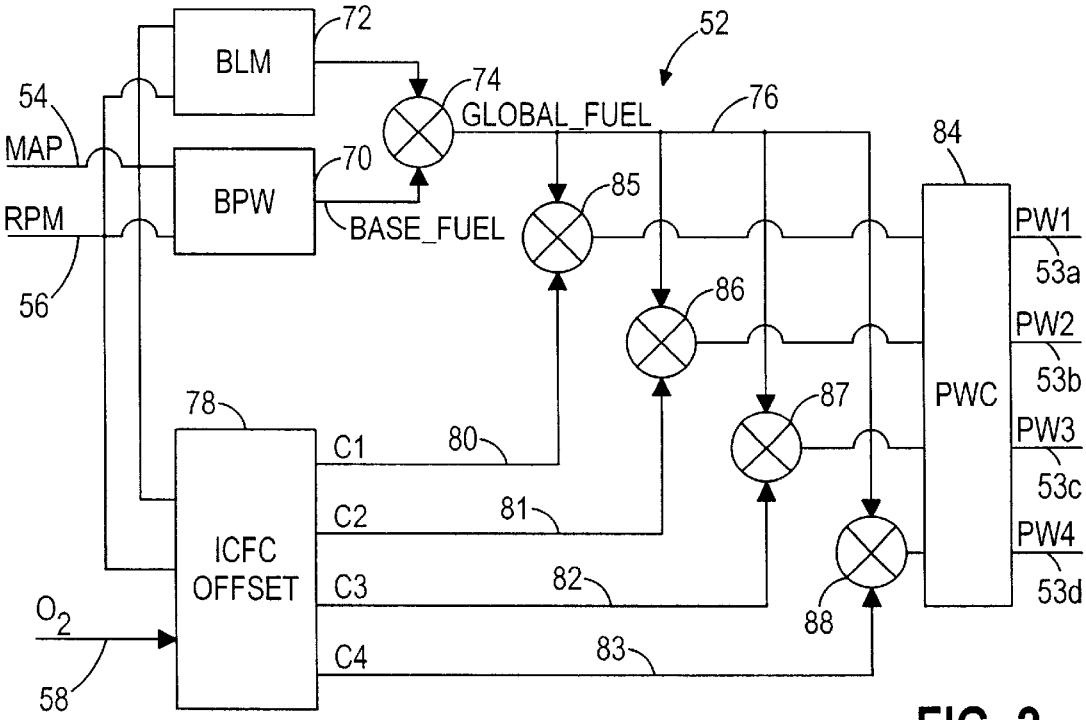
FIG. 2 is a block diagram of the control method carried out by the engine control module of FIG. 1 according to the invention.

FIG. 2 is a block diagram illustrating the above-described functionality of ECM 52. Thus, the MAP, RPM and $O_2$ inputs are received on lines 54, 56 and 58, respectively, and individual cylinder injector pulse width signals PW1, PW2, PW3, PW4 are developed on lines 53*a*, 53*b*, 53*c* and 53*d*, respectively. A global fuel amount GLOBAL_FUEL is determined as a function of MAP and RPM, using the non-volatile look-up tables 70 and 72. Table 70 is developed through extensive modeling and calibration, and provides the base fuel amount BASE_FUEL. Table 72 stores closed-loop fueling corrections, also as a function of MAP and RPM, and is referred to herein as the block learning memory, or BLM. As is well known to those skilled in the art, the BLM table entries are determined based on the $O_2$ input, which when adequately filtered, provides a measure of the deviation of the average engine air/fuel ratio from stoichiometry. The base fuel amount BASE_FUEL and the block learning correction from tables 70 and 72 are summed at summer 74 to form the global fuel pulse width GLOBAL_FUEL on line 76. The Individual Cylinder Fuel Control (ICFC) Offset block 78 is responsive to the $O_2$, MAP and RPM input signals, and develops correction factors C1, C2, C3 and C4 on lines 80, 81, 82 and 83 that are applied to GLOBAL_FUEL to form individual cylinder fuel amounts that are converted into the injector pulse width signals PW1, PW2, PW3 and PW4 at Pulse Width Converter (PWC) block 84. Thus, the correction factors C1, C2, C3 and C4 are applied along with the GLOBAL_FUEL to the multipliers 85, 86, 87, 88 and PWC block 84 to form the injector pulse width signals PW1, PW2, PW3 and PW4 on lines 53*a*, 53*b*, 53*c* and 53*d*, respectively.

Figure 3:
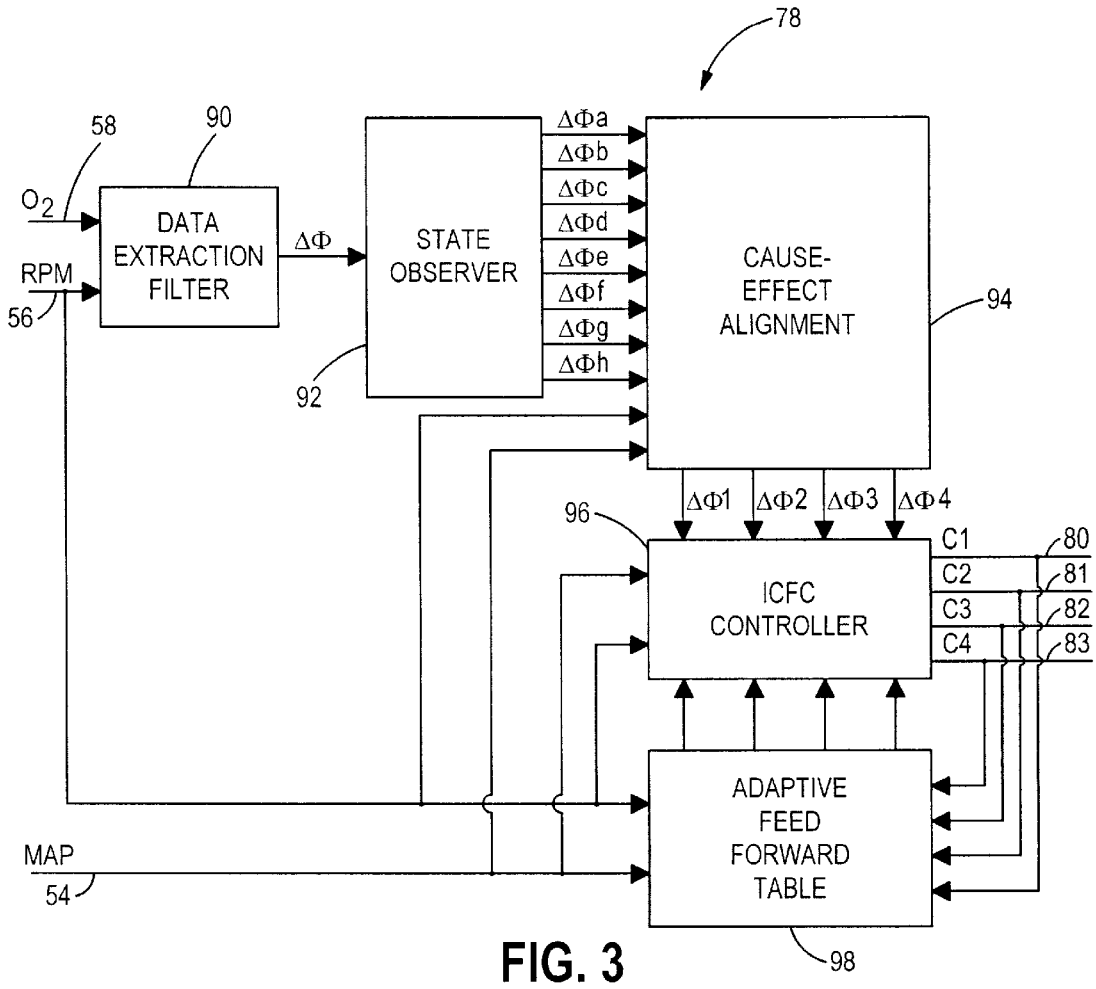
FIG. 3 is a block diagram detailing a portion of the block diagram of FIG. 2 concerning the development of individual cylinder fuel control correction factors according to this invention.

FIG. 3 depicts the functionality of ICFC Offset block 78 as a series of five interconnected blocks 90, 92, 94, 96 and 98, which are described in general in this paragraph and in detail thereafter. As indicated in FIG. 2, the MAP, RPM and $O_2$ inputs are received on lines 54, 56 and 58, respectively, and individual cylinder correction values C1, C2, C3 and C4 are developed on lines 80, 81, 82 and 83, respectively. The $O_2$ and RPM inputs are applied to the Data Extraction Filter 90, which samples the $O_2$ input and filters the sampled values with an RPM-dependent high-pass filter to form a time-varying air/fuel ratio imbalance signal $\Delta\Phi$. The imbalance signal $\Delta\Phi$, in turn, supplied as an input to State Observer 92, which parses $\Delta\Phi$ into an array of imbalance values $\Delta\Phi a$–$\Delta\Phi h$. The imbalance values $\Delta\Phi a$–$\Delta\Phi h$, in turn, are applied as inputs to the Cause-Effect Alignment block 94, which associates the imbalance values $\Delta\Phi a$–$\Delta\Phi h$ with individual engine cylinders based on MAP vs. RPM engine operating point, producing cylinder-specific imbalance values $\Delta\Phi 1$, $\Delta\Phi 2$, $\Delta\Phi 3$ and $\Delta\Phi 4$. Finally, the imbalance values $\Delta\Phi 1$, $\Delta\Phi 2$, $\Delta\Phi 3$ and $\Delta\Phi 4$ are applied to the ICFC Controller 96, which develops the correction factors C1, C2, C3 and C4 for the respective engine cylinders so as to reduce the imbalance in each cylinder while preserving the overall or average air/fuel ratio established by the closed-loop control. When it appears that the correction factors C1, C2, C3, C4 have settled, the Offset Controller 96 is reset, and the correction factors are stored in Adaptive Feed-Forward Table 98 for use by ICFC Controller 96. As indicated, the correction factors C1, C2, C3, C4 are stored in Table 98 based on MAP vs. RPM engine operating point.

Figure 5:
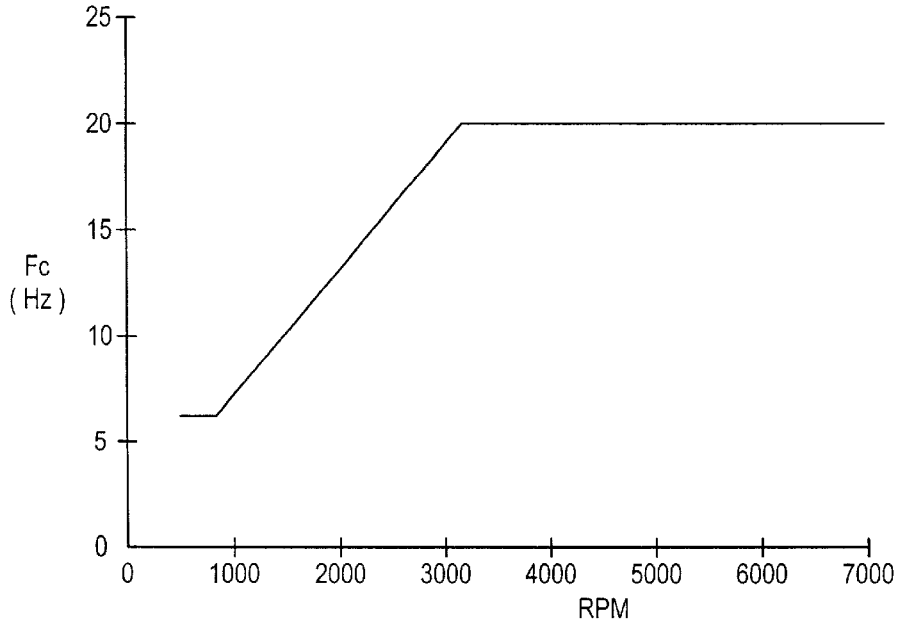
FIG. 5 graphically depicts the cut-off frequency of a high-pass data extraction filter according to this invention.
Figure 4A:
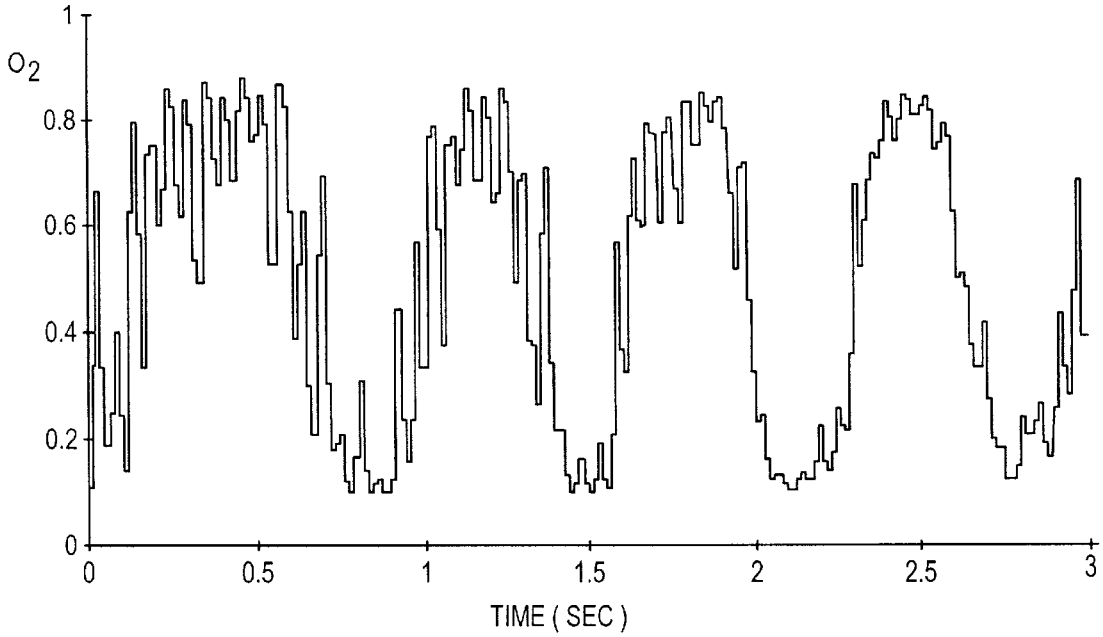
FIG. 4A graphically depicts a representative output signal developed by the exhaust gas oxygen sensor of FIG. 1.
Figure 4B:
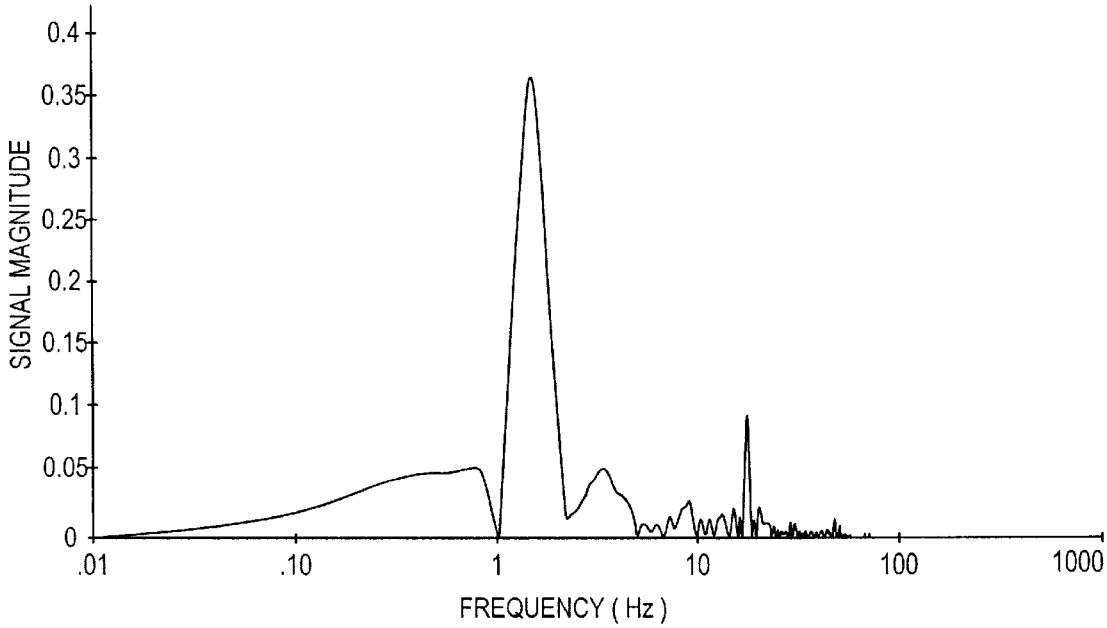
FIG. 4B graphically depicts the frequency spectrum content of the exhaust gas oxygen sensor output signal of FIG. 4A.

As indicated above, the Data Extraction Filter 90 samples the $O_2$ input and filters the sampled values with an RPM-dependent high-pass filter to form a time-varying air/fuel ratio imbalance signal $\Delta\Phi$. FIG. 4A graphically depicts typical normalized variation of the $O_2$ signal voltage as a function of time for an engine speed of 100 rpm and a manifold absolute pressure of 50 kPa, while FIG. 4B depicts the frequency content of the signal depicted in FIG. 4A. The dominant low frequency oscillation seen in FIG. 4A corresponds to the large spectral content spike at approximately 1.6 Hz, and occurs due to a characteristic dithering of the closed-loop fuel controller. On the other hand, the higher frequency oscillation superposed on the low frequency oscillation corresponds to the narrow spectral content spike at approximately 16.7 Hz, and occurs due to cylinder-to-cylinder air/fuel ratio imbalances. Data Extraction Filter 90 extracts the higher frequency oscillation with a discrete second-order Butterworth filter of the form:

$$y(n)=[b(1)*u(n)]+[b(2)*u(n-1)]+[b(3)*u(n-2)]-[a(2)*y(n-1)]-[a(3)*y(n-2)] \quad (1)$$

where y(n), y(n−1) and y(n−2) are output values of the filter for the current, previous and second previous program loops; and u(n), u(n−1) and u(n−2) are input values to the filter for the current, previous and second previous sample values. The coefficients b(1), b(2), b(3), a(2) and a(3) selected as a function of the filter execution rate and engine speed RPM. The engine speed dependency causes the filter cut-off frequency Fc to increase with increasing RPM, as shown for example, in the graph of FIG. 5. This is required to reliably separate the relatively high frequency imbalance information from the relatively low frequency dithering, since (1) the frequency of the imbalance information increases with increasing RPM; and (2) the frequency of the closed-loop dithering may also tend to increase with increasing RPM. In other words, the cut-off frequency Fc is scheduled so that the filter provides minimal attenuation of the imbalance information frequency and maximal attenuation of the closed-loop dithering frequency. In the illustrated embodiment, the filter output is only utilized during quasi-steady state operation of the engine, allowing the filter coefficients to be updated at a relatively slow rate, such as 1 Hz.

The State Observer 92 samples the imbalance signal ΔΦ at the same rate as the data extraction block 90 samples the $O_2$ signal—namely, twice the firing frequency. Thus, in the illustrated embodiment where engine 10 has four cylinders, the state observer samples the imbalance signal ΔΦ eight times per engine firing cycle. The sample values are shifted through a carousel of registers and low pass filtered with prior corresponding samples to reduce any jitter due to non-linearity of the oxygen sensor 64. For example, the first position in the carousel (ΔΦa) contains filtered data from the most recent ΔΦ sample, the second position (ΔΦb) contains the filtered data from the second most recent ΔΦ sample, and so on. Depending on the exhaust-side geometry of engine 10, the imbalance values applied to the carousel may be developed by a set of equations that model plant dynamics, including cylinder-to-cylinder exhaust gas mixing, for example. However, in a mechanization of the present invention, such plant dynamics were found to be relatively minor, obviating the need for modeling in State Observer 92.

Due to sensor, exhaust transport, and filtering delays, the imbalance values ΔΦa–ΔΦh produced by State Observer 92 lag the corresponding engine cylinder events. These delays vary depending on engine operating point, and are not accounted for by the State Observer 92. Instead, the Cause-Effect Alignment block 94 associates the imbalance values ΔΦa–ΔΦh with individual engine cylinders to produce the cylinder-specific imbalance values Δϕ1, ΔΦ2, ΔΦ3 and ΔΦ4. In other words, there exists a variable phase offset between any given imbalance value produced by State Observer 92 and the engine cylinder whose firing event gave rise to that imbalance value. The offset value varies with the MAP vs. RPM operating point of the engine, and the appropriate offset values may be empirically determined for various combinations of MAP and RPM by imposing a square wave on the BASE_FUEL for one or more cylinders, and identifying which of the imbalance values ΔΦa–ΔΦh is in phase with the imposed square wave. These offset values are then stored in a look-up table within Cause-Effect Alignment block 94 for purposes of identifying an imbalance value for each of the engine cylinders. For example, if the offset for a given operating point is four, the imbalance data in the fourth position (i.e., ΔΦd) represents the imbalance ΔΦ1 for the first cylinder of the firing order, and so on. In a mechanization of the present invention, the variation in offset value with operating point was relatively minor, which of course greatly simplified the look-up table.

The ICFC Controller block 96 responds to the cylinder-specific imbalance values ΔΦ1, ΔΦ2, ΔΦ3 and ΔΦ4 and to the learned data stored in Feed-Forward Adaptive Table 98 to develop correction factors C1, C2, C3 and C4 that reduce the imbalance in each respective cylinder while preserving the overall or average air/fuel ratio established by the closed-loop control. Thus, there are three aspects of the control: closed-loop feedback control, adaptively learned feed-forward values, and average zeroing of the correction factors.

The basic control includes feed-forward, proportional feedback and integral feedback terms as follows:

$$C_n = C_{ff} + (Kp * \Delta\Phi_n) + \Sigma(Ki * \Delta\Phi_n) \quad (2)$$

where $C_{ff}$ is a feed-forward correction obtained from Table 98, Kp is a proportional gain term and Ki is an integral gain term. In the illustrated embodiment, the control equation (2) is updated at the engine firing rate, requiring the integral gain term Ki to be reduced with increasing engine speed to compensate for the corresponding rate of change of the integral term. Also, since different correction values are learned for different MAP vs. RPM operating points, the integral term is reset each time a new MAP vs. RPM region is entered, and whenever the current correction values are transferred to Table 98. The current correction values are transferred to Table 98 when three conditions have been met: (1) the engine has been operating in a given MAP vs. RPM region for more than a predefined period of time, (2) the correction values all have settled, and (3) at least one of the settled correction values is significantly different than the corresponding value stored in Table 98. Settling of a correction value can be detected by comparing the correction value to a moving average of its values; when the correction value remains substantially equal to its moving average for at least a predefined period of time, the correction value is deemed to have settled. Alternatively, settling of a correction value can be detected by high-pass filtering the correction value to extract its variation, and resetting a timer whenever the magnitude of the variation exceeds a calibrated threshold; when the timer reaches a predetermined value, the correction value is deemed to have settled.

Average zeroing of the correction factors is performed to preserve the overall or average air/fuel ratio established by the closed-loop control. In other words, the average value of all of the correction factors should be nearly equal to one; otherwise, the average or overall air/fuel ratio of the engine will drift upward or downward, possibly creating an undesired interaction between the closed-loop control and the individual cylinder fuel control of this invention. According to this invention, average zeroing of the correction factors is achieved by introducing a fourth term $C_{avg}$ into the control equation (2) as follows:

$$C_n = C_{avg} + C_{ff} + (Kp * \Delta\Phi_n) + (Ki * \Sigma\Delta\Phi_n) \quad (3)$$

where $C_{avg}$ is based on the deviation of the average of the correction values from one. In other words, each time the control is updated, ICFC Controller 96 computes the average of the correction values and the deviation DEV of the average from one, and sets $C_{avg}$ equal to the product (DEV*Kavg), where Kavg is a feedback gain term. Accordingly, if the average of the correction values deviates from unity, the feedback term $C_{avg}$ becomes active to drive the average of the correction values back to unity.

In summary, the present invention provides a method of achieving individual cylinder air/fuel control without the expense of multiple oxygen sensors or sophisticated real-time mathematical modeling. While this invention has been described in reference to the illustrated embodiment, it is expected that various modifications in addition to those suggested above will occur to those skilled in the art. For example, the $O_2$ signal may be sampled at a higher rate than specified herein, in which case the ΔΦ imbalance signal may be sampled at a different rates than the $O_2$ signal, and so on. Obviously, many such modifications will occur to those skilled in the art, and it should be understood in this regard that the scope of this invention is not limited to the illustrated embodiment, and that fuel controls incorporating such modifications may fall within the scope of this invention, which is defined by the appended claims.

What is claimed is:

1. A control method for fueling a plurality of individual cylinders of a multi-cylinder internal combustion engine based on an output signal of a single oxygen sensor positioned to respond to exhaust gases generated in the individual cylinders, the control method comprising the steps of:

high-pass filtering the oxygen sensor output signal to form an imbalance signal that is a measure of air/fuel ratio imbalances among the engine cylinders;

parsing the imbalance signal into an array of imbalance values indicative of the measured air/fuel ratio imbalance at predefined points of an engine firing cycle;

retrieving previously stored offset values that associate each engine cylinder with an imbalance value from said array;

developing a fuel correction amount for each engine cylinder based on the imbalance value associated with such cylinder;

adjusting a base fuel amount by the correction amount for each cylinder to form separate fuel commands for each of said engine cylinders; and fueling each cylinder based on its respective fuel command.

2. The control method of claim 1, wherein the output signal of said oxygen sensor has a characteristic oscillation due to dithering of an average air/fuel ratio of said engine, where such oscillation increases with increasing engine speed, and said control method includes the step of:

increasing a cutoff frequency of said high pass filtering with increasing engine speed so that said characteristic oscillation is excluded from said imbalance signal regardless of the engine speed.

3. The control method of claim 1, wherein different offset values are stored and retrieved for different operating points of said engine.

4. The control method of claim 1, wherein the step of parsing the imbalance signal includes the steps of:

sampling the imbalance signal at a multiple of a firing frequency of the engine; and storing the imbalance signal samples in an array.

5. The control method of claim 4, including the steps of:

low-pass filtering the imbalance signal samples with prior corresponding imbalance signal samples; and storing the low-pass filtered imbalance signal samples in said array.

6. The control method of claim 1, including the step of:

adjusting the developed fuel correction amounts in a direction to prevent said developed fuel correction amounts from changing an overall air/fuel ratio of said engine.

7. The control method of claim 6, wherein the step of adjusting the developed fuel correction amounts includes the steps of:

determining an average of said developed fuel correction amounts;

determining a deviation of the determined average from a reference average correction amount that will not change the overall air/fuel ratio of said engine; and adjusting the developed fuel correction amounts based on the determined deviation.

8. The control method of claim 1, including the steps of:

storing the developed fuel correction amounts as a function of engine operating point under predefined conditions; and developing the fuel correction amount for each engine cylinder based on said stored correction amount and the imbalance value associated with such cylinder.

9. The control method of claim 8, wherein said predefined conditions include: (a) a detected settling of the developed fuel correction amounts, and (b) a detected difference between the developed fuel correction amounts and said stored fuel correction amounts.

10. The control method of claim 9, wherein settling of said developed fuel correction amounts is detected when each of said developed fuel correction amounts remains substantially equal to a moving average of its values for at least a predefined period of time.

11. The control method of claim 9, including the steps of:

high-pass filtering each correction value to extract its variation;

resetting a timer for each correction value whenever a magnitude of its variation exceeds a calibrated threshold; and detecting settling of said developed fuel correction amounts when said timers each reach a predetermined value.

* * * * *